United States Patent [19]

Chateau

[11] 4,036,199

[45] July 19, 1977

[54] DEVICE FOR PROTECTING AN IGNITION DEVICE FOR MOTOR VEHICLES

[75] Inventor: Louis Jean Château, Rosny-sur-Bois, France

[73] Assignee: Ducellier & Cie, Paris, France

[21] Appl. No.: 667,465

[22] Filed: Mar. 16, 1976

[30] Foreign Application Priority Data

Mar. 18, 1975 France ..... 75.08332

[51] Int. Cl.[2] ..... H05B 37/02

[52] U.S. Cl. ..... 123/148 E; 123/148 S; 315/224; 361/4; 361/91

[58] Field of Search ..... 123/148 D, 148 DC, 148 S, 123/148 E, 198 DC; 317/9 B, 11 C, 16, 31; 315/224

[56] References Cited

U.S. PATENT DOCUMENTS

| | | | |
|---|---|---|---|
| 2,223,151 | 11/1940 | Nadler | 123/148 D |
| 3,295,014 | 12/1966 | Fisher et al. | 123/148 E |
| 3,605,713 | 9/1971 | le Masters et al. | 123/148 E |
| 3,725,675 | 4/1973 | Olsen | 317/31 |
| 3,882,840 | 5/1975 | Adamian et al. | 123/148 E |
| 3,889,159 | 6/1975 | Wessel | 317/31 |
| 3,940,658 | 2/1976 | Allred | 123/148 E |
| 3,941,112 | 3/1976 | Habert | 123/148 DC |

FOREIGN PATENT DOCUMENTS

| | | | |
|---|---|---|---|
| 2,243,294 | 3/1974 | Germany | 123/148 E |
| 2,406,018 | 8/1974 | Germany | 123/148 E |

*Primary Examiner*—Carroll B. Dority, Jr.
*Assistant Examiner*—Paul Devinsky

[57] ABSTRACT

A device for protecting an ignition device, particularly for motor vehicles, equipped with an internal combustion engine, in which a zener diode controls, by means of at least two transistors the placing in short-circuit of a resistor connected in series with the primary winding of an ignition coil and a control device in such a manner that when the supply voltage of the device exceeds a determined value, the resistor acts in series with the coil, which avoids damage to the ignition device.

3 Claims, 5 Drawing Figures

Figure 1:
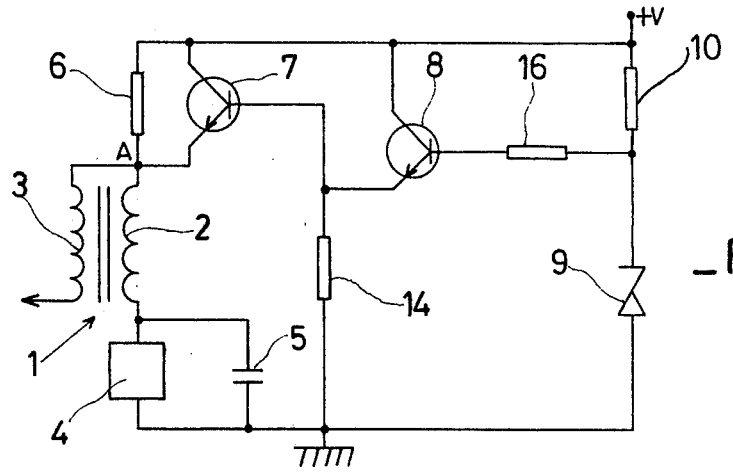

FIG. 4
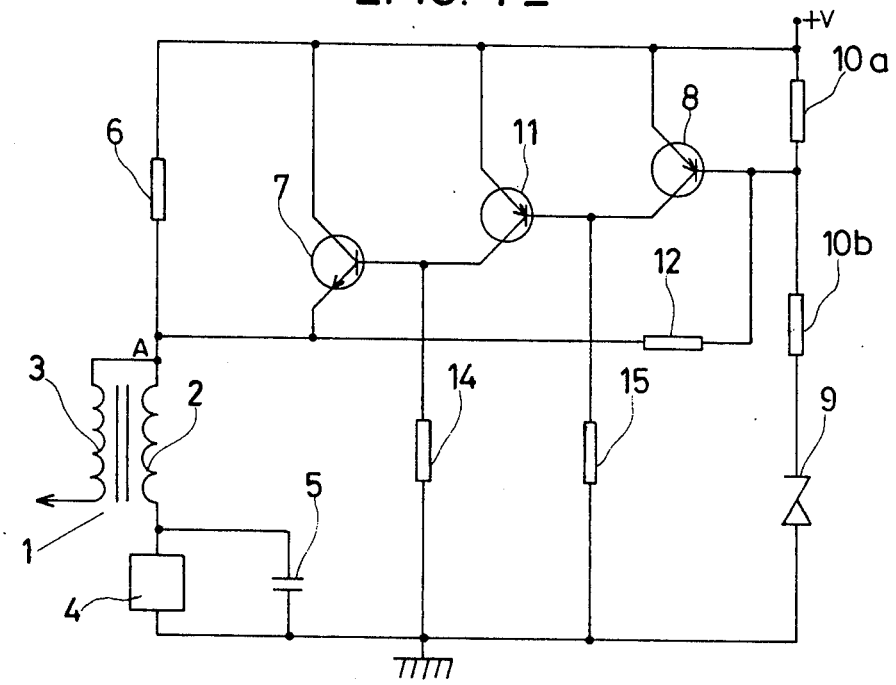
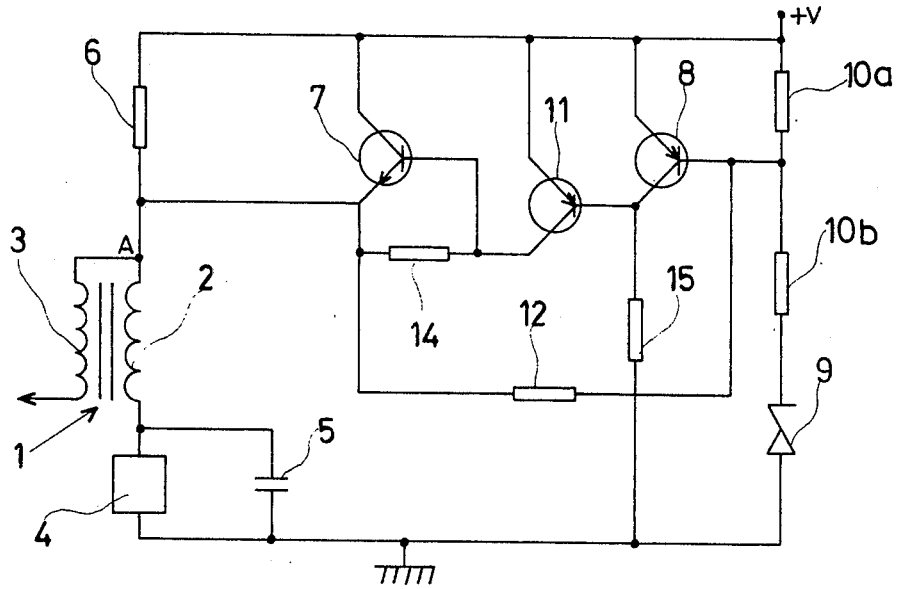
FIG. 5

DEVICE FOR PROTECTING AN IGNITION DEVICE FOR MOTOR VEHICLES

This invention relates to a protection circuit for the ignition system of an internal combustion engine of a motor vehicle.

It has previously been proposed to utilize two batteries in an internal combustion engine electrical system. The two batteries are connected in series for starting only and this has the effect of applying an abnormally high voltage across the ignition circuit which usually comprises an ignition coil with its primary winding connected in series with a control device between the supply terminals. This high voltage can cause serious damage to the control device. A resistor could be connected in series with the coil to give protection, but this would result in the coil current being reduced to an unsatisfactory level when only a single battery is in use.

It is an object of the invention to provide an ignition system with a protection circuit which overcomes these problems.

In accordance with the invention there is provided an ignition system including an ignition coil having primary and secondary windings, a control device for the ignition coil, a current-limiting resistor, the primary winding, control device and the current limiting resistor being connected in series between a pair of supply terminals, and a circuit for short-circuiting the current-limiting resistor when the voltage on the supply terminals is less than a predetermined value, said circuit comprising a zener diode and at least one resistor connected in series between the supply terminals, said zener diode conducting when there is a voltage in excess of said predertermined value on the supply terminals, a first transistor having its base connected to one electrode of the zener diode and a second transistor of which the emitter-collector junction is connected across the current-limiting resistor, the base of the second transistor being connected to one of the electrodes of the first transistor so that said second transistor is conductive when the zener diode is non-conductive.

The description which follows with reference to the accompanying diagrammatic drawings will facilitate a better understanding of how the invention can be carried out.

In the drawings:

FIGS. 1 to 5 represent schematically five examples of a protection circuit according to the invention.

Referring firstly to FIG. 1, the ignition system comprises an ignition coil 1 having a primary winding 2 and a secondary winding 3, a current-limiting resistor 6 in series with the primary winding 2, a control device 4 which may be particularly a mechanical contact breaker or a transistor or any other known means and a capacitor 15 shunting the control device 4.

The protection circuit connected in series between the positive supply terminal and an earth terminal. A first transistor 8 is controlled by the zener diode 9, and a second transistor 7 is directly coupled to the transistor 8.

The transistors 7 and 8 are of the n-p-n type. The base of the transistor 8 is connected via a resistor 16 to the junction of the resistor 10 and the zener diode 9. The resistor 10 is connected between the positive supply terminal and the cathode of the zener diode 9. The collector of the transistor 8 is connected to the positive supply terminal and its emitter to the base of the transistor 7. A resistor 14 connected between the base of the transistor 7 and the earth terminal acts as a load resistor. The collector of the transistor 7 is connected to the positive supply terminal and its emitter to a terminal A common to the resistor 6 and to the coil 1, in such a manner that the emitter-collector junction is in parallel with the resistor 6.

The operation of such device is as follows: When the supply voltage is less than the zener voltage of the diode 9, no current flows through the diode 9. The transistor 8 is biased by the resistors 10 and 16, so that the voltage at the emitter of the transistor 8 is that of the supply diminished by the value of one junction voltage drop. Thus the emitter of the transistor 7 is at a voltage equal to that of the supply diminished by the value of two junction voltage drops. This difference is sufficient to short-circuit the resistor 6. When the supply voltage is greater than the zener voltage of the diode 9, the base of the transistor 8 is at the potential determined by the diode 9, its emitter is at the same potential diminished by the value of one junction voltage drop. The emitter of the transistor 7 at the same potential diminished by the value of two junction voltage drops, the resistor 6 is then in series with the primary 2 of the coil 1 when the latter has reached saturation.

Figure 2:
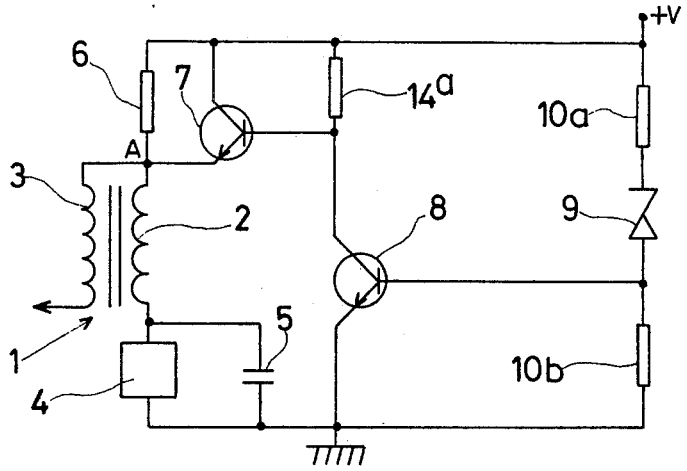

In the example shown in FIG. 2, the zener diode 9 is in series with two resistors **10*a* and 10*b*, between the positive supply terminal and the earth terminal. The transistors 8 and 7 are of the n-p-n type. The transistor 7 is arranged according to FIG. 1 with its collector-emitter in parallel with the resistor 6. The base of the transistor 7 is connected to the collector of the transistor 8 and also to the positive supply terminal through a resistor 14*a*. The emitter of the transistor 8 is connected to earth and its base to the junction between the anode of the zener diode 9 and the resistor 10*b***.

When the supply voltage is less than the zener voltage of the diode 9, no current flows in the resistors **10*a* and 10*b*, and the transistor 8, having its base and its emitter at the same potential, is non-conducting. The transistor 7 having its base connected by the resistor 14*a* to the positive pole is then saturated and short-circuits the resistor 6**.

When the supply voltage becomes greater than the predetermined value, the transistor 8 becomes conducting as soon as the voltage across the resistor **10*b* reaches the value of the junction voltage drop, the diode 9 is conducting. The potential at the collector of the transistor 8 decreases and blocks the transistor 7, leaving the resistor 6** in series with the coil.

Figure 3:
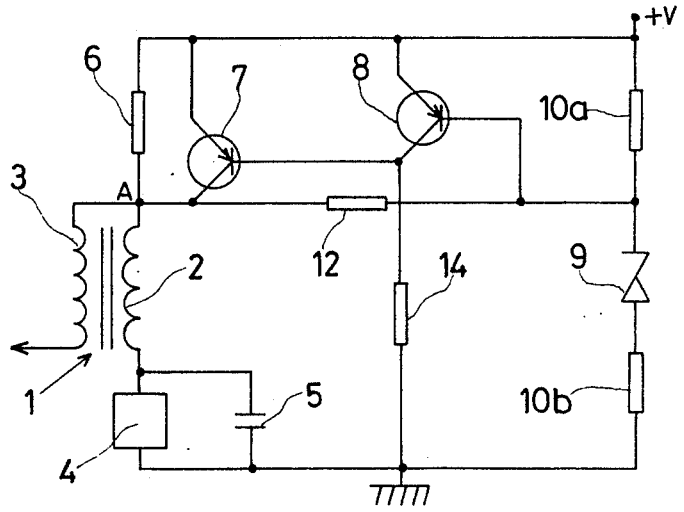

In the example shown in FIG. 3, the zener diode 9 is again in series with the resistors **10*a* and 10*b*. The transistors 7 and 8 are of the p-n-p type. In this case it is the emitter of the transistor 7 which is connected to the positive supply terminal and its collector is connected to the point A. The base of the transistor 7 is connected to the collector of the transistor 8 and also to earth through the resistor 14. The emitter of the transitor 8 is connected to the positive pole of the supply source, and its base to the junction between the resistor 10*a* and the cathode of the zener diode 9. A feedback resistor 12 connects the base of the transistor 8** to the point A.

In this case, the resistor **10*a* controls the biasing of the transistor 8, and the resistor 14 that of the transistor 7**.

In the example shown in FIG. 4 there is an additional transistor 11 interposed between the transistors 7 and 8 as an amplifier stage. A resistor 15 connected between the collector of the transistor 8 and the earth terminal, to bias the transistor 11 to conduct. The transistors 8 and 11 are p-n-p types but the transistor 7 is an n-p-n type.

In this case when the supply voltage is less than the zener voltage, the diode 9 is not conducting and there is no voltage across the resistor 10*a*. The transistor 8 does not conduct, so that the transistor 11 is saturated by the presence of the resistor 15. The transistor 7 is biased by the transistor 11, to conduct and so short-circuit the resistor 6.

When the supply voltage is greater than the zener voltage the diode 9 conducts, so as to saturate the transistor 8. This switches off the transistor 11. The transistor 7 of which the base is connected to earth by the resistor 14 is also switched off, the resistor 6 being left in series with the coil.

Turning finally to FIG. 5, this circuit differs from that shown in FIG. 4 in the manner in which the resistor 14 is connected. Instead of being connected between the base of the transistor 7 and the earth terminal resistor 14 is connected between the base and emitter of the transistor 7.

In this case, the operation of the circuit is similar to that of the circuit of FIG. 4. The connection of the resistor 14 between the base and emitter of the transistor 7 ensures the switching off of the transistor 7 since its emitter and its base are at the same potential when the supply voltage is greater than the zener voltage.

I claim:

1. An internal combustion engine ignition system comprising an ignition coil having primary and secondary windings, a control device for the ignition coil, a current limiting resistor, the primary winding, control device and the current-limiting resistor being connected in series between a pair of supply terminals, and a circuit for short-circuiting the current-limiting resistor when the voltage on the supply terminals is less than a predetermined value, said circuit comprising a zener diode and at least one resistor connected in series between the supply terminals, said zener diode conducting when there is a voltage in excess of said predetermined value on the supply terminals, a first transistor having its base connected to one electrode of the zener diode a second transistor of which the emitter-collector junction is connected across the current-limiting resistor, the base of the second transistor being connected to one of the electrodes of the first transistor so that said second transistor is conductive when the zener diode is non-conductive.

2. A system as claimed in claim 1 including a third transistor connected as an amplifier stage between the first and second transistors.

3. A system as claimed in claim 1 in which there is a feedback resistor connected between the junction of the current-limiting resistor with the coil and the base of the first transistor.

* * * * *